US005842694A

United States Patent [19]

Brooks et al.

[11] Patent Number: 5,842,694

[45] Date of Patent: Dec. 1, 1998

[54] STACK HEIGHT CONTROL WITH HEIGHT SENSING FEEDHEAD

[75] Inventors: Janice S. Brooks, Fairport; Ermanno C. Petocchi, Rochester, both of N.Y.

[73] Assignee: Xerox Corporation, Stanford, Conn.

[21] Appl. No.: 583,830

[22] Filed: Jan. 11, 1996

[51] Int. Cl.[6] ..... B65H 1/18

[52] U.S. Cl. ..... 271/38; 271/110; 271/117; 271/162

[58] Field of Search ..... 271/152, 153, 271/155, 154, 162, 126, 117, 121, 110, 38

[56] References Cited

U.S. PATENT DOCUMENTS

| | | | |
|---|---|---|---|
| 3,981,497 | 9/1976 | Feinstein, Jr. et al. | 271/153 X |
| 4,589,645 | 5/1986 | Tracy | 271/3.1 |
| 5,033,731 | 7/1991 | Looney | 271/176 |
| 5,228,673 | 7/1993 | Osonoe | 271/153 X |
| 5,383,654 | 1/1995 | Iseda | 271/152 X |
| 5,624,108 | 4/1997 | Kubo | 271/152 X |

FOREIGN PATENT DOCUMENTS

| | | | |
|---|---|---|---|
| 664760 | 3/1994 | Japan | 271/153 |

*Primary Examiner*—David H. Bollinger

*Attorney, Agent, or Firm*—Kevin R. Kepner

[57] ABSTRACT

A stack height control assembly utilizing the feedhead as the height sensing member. As a result of incorporating the stack height sensor into the feedhead, several advantages are realized. There is no additional drag imparted to the sheets as the result of a sensing arm or other sensing member. This also reduces the possibility of skewing the sheets with an additional sensing member. The feedhead, due to the normal force required to acquire the sheets also provides an accurate measurement of stack height. The normal force of the feedhead also eliminates and inaccuracies that could be caused by curled sheets in a feed tray. The stack height is also measured "on the fly" as the sheets are being acquired and fed, thus providing an efficient stack height sensing scheme. A floating coupler and sensor flag arrangement can be mounted so that it is engaged with a paper supply drawer as the drawer is moved into an operative position. The feedhead acts as the stack height sensor and through a mechanical engagement with the sensor, which is removed and remote from the supply drawer, signals as the stack is depleted and the elevator mechanism should raise the stack. This control scheme removes complex electrical connectors from the drawer assembly and allows a wide range of substrates to be fed from the paper supply drawer. By allowing the sensor/coupler arrangement to float so as to align with the drawer, the need for extremely tight manufacturing and assembly tolerances with respect to the drawer/sensor arrangement is also obviated.

14 Claims, 6 Drawing Sheets

STACK HEIGHT CONTROL WITH HEIGHT SENSING FEEDHEAD

This invention relates generally to a cut sheet feeder, and more particularly concerns a height sensing feedhead for use in feeding cut sheets in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In printing machines such as those described, copy sheets are fed from one or more trays into the print module. To function properly, the stack of sheets must be kept within a range at which the feed head will properly acquire separate and feed each individual sheet. Various types of sensors have been utilized within sheet trays to maintain the stack of sheets within a predetermined acquisition range. Additionally, other passive types of sheet trays utilize a biased tray in which the stack of sheets is continually forced against a portion of the feed head so as to always provide a ready sheet for feeding.

Problems with the above methods are that often a sensor or switch does not react to curled edges on sheets and gives a false reading, thereby resulting in improperly fed sheets from the stack. The passive spring loaded trays, while always providing a sheet for ready acquisition are somewhat limited in the latitude of paper weights and types which can be fed due to the fixed nature of the spring force in the tray.

It is desirous to have a sheet feeding tray having a wide latitude of paper feeding capabilities yet not having electrical connections and/or sensor switches which may indicate false readings for the stack height level and/or have reliability problems due to continual connection and reconnection when a tray is slid open for refilling.

The following disclosures may be relevant to various aspects of the present invention:

U.S. Pat. No. 5,033,731

Inventor: Looney

Issue Date: Jul. 23, 1991

U.S. Pat. No. 4,589,645

Inventor: Tracy

Issue Date: May 20, 1986

The relevant portions of the foregoing disclosures may be briefly summarized as follows:

U.S. Pat. No. 5,033,731 describes a sheet stacking control system in which a plural mode stack height sensing and sheet delivery device in which a first signal is generated in response to a sheet being fed from the stack and a second distinct signal is generated at full stack condition.

U.S. Pat. No. 4,589,645 discloses a document set separator and stack height sensor adapted to generate signals at different preset levels to indicate the height of a stack to be fed.

In accordance with one aspect of the present invention, there is provided a sheet feeding apparatus for feeding cut sheets from a stack of sheets. The apparatus comprises a sheet support for supporting a stack of sheets, a feedhead sensor, adjacent said sheet support and a stack height controller, operatively connected to receive a signal from said sensor, to raise the height of the stack in said sheet support as the sheets are fed and the stack height is depleted Pursuant to another aspect of the present invention, there is provided an electrophotographic printing machine wherein sheets are fed from a stack. The printing machine comprises a sheet support for supporting a stack of sheets, a feedhead sensor, adjacent said sheet support and a stack height controller, operatively connected to receive a signal from said sensor, to raise the height of the stack in said sheet support as the sheets are fed and the stack height is depleted.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
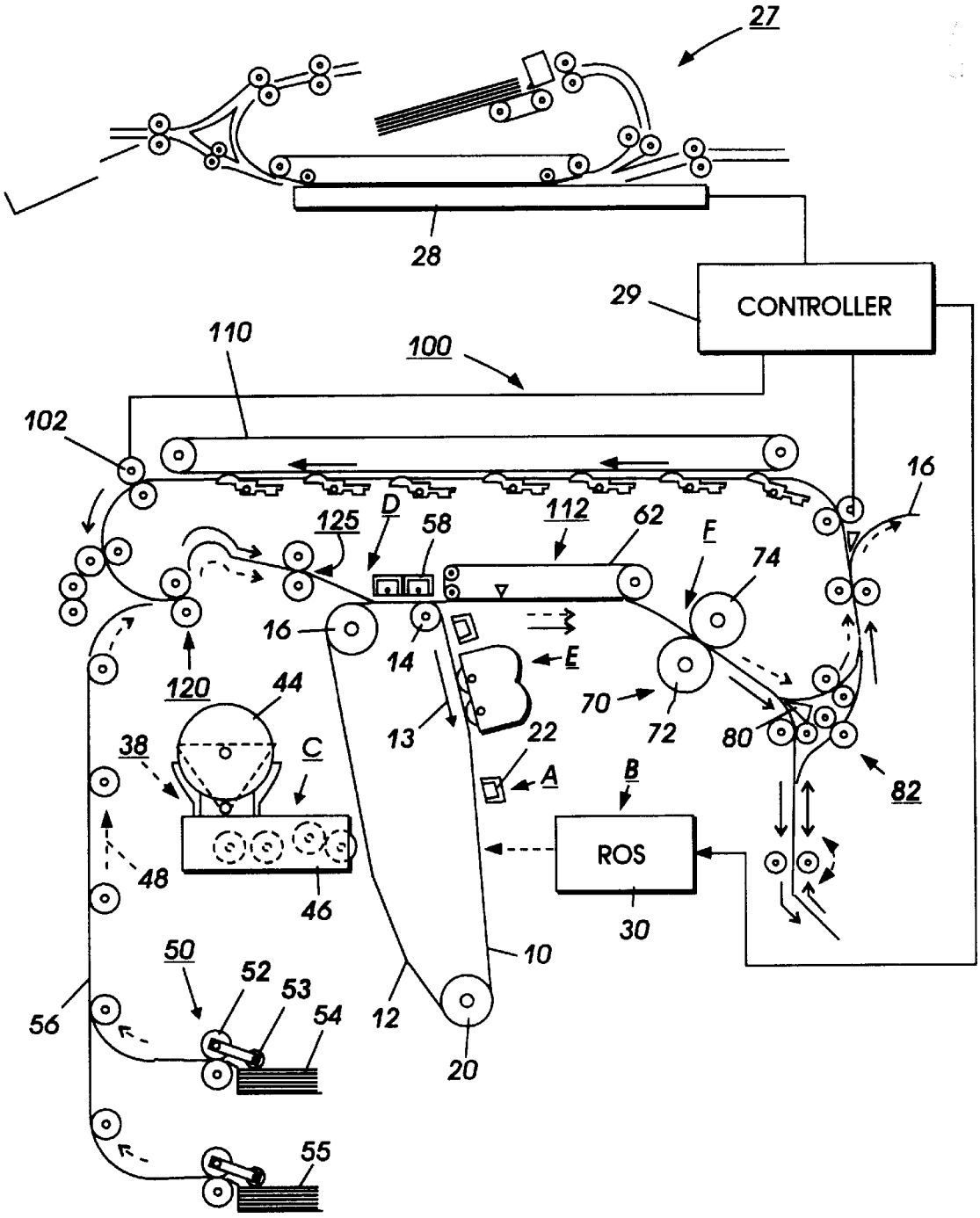
FIG. 1 is a schematic elevational view of a typical electrophotographic printing machine utilizing the stack height control therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the remote stack height sensing control assembly of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS illuminates the charged portion of photoconductive belt 10. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 53 contacting the uppermost sheet of stack 54. Nudger roll 53 rotates to advance the uppermost sheet from stack 54 into the nip formed by feed roll 52 and the retard roll 51 (FIG. 2) which advances the sheet into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72.

The sheet then passes through fuser 70 where the image is permanently fixed or fused to the sheet. After passing through fuser 70, a gate 80 either allows the sheet to move directly via output 16 to an output device such as a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 16. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 16.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the features of the present invention therein.

Figure 2:
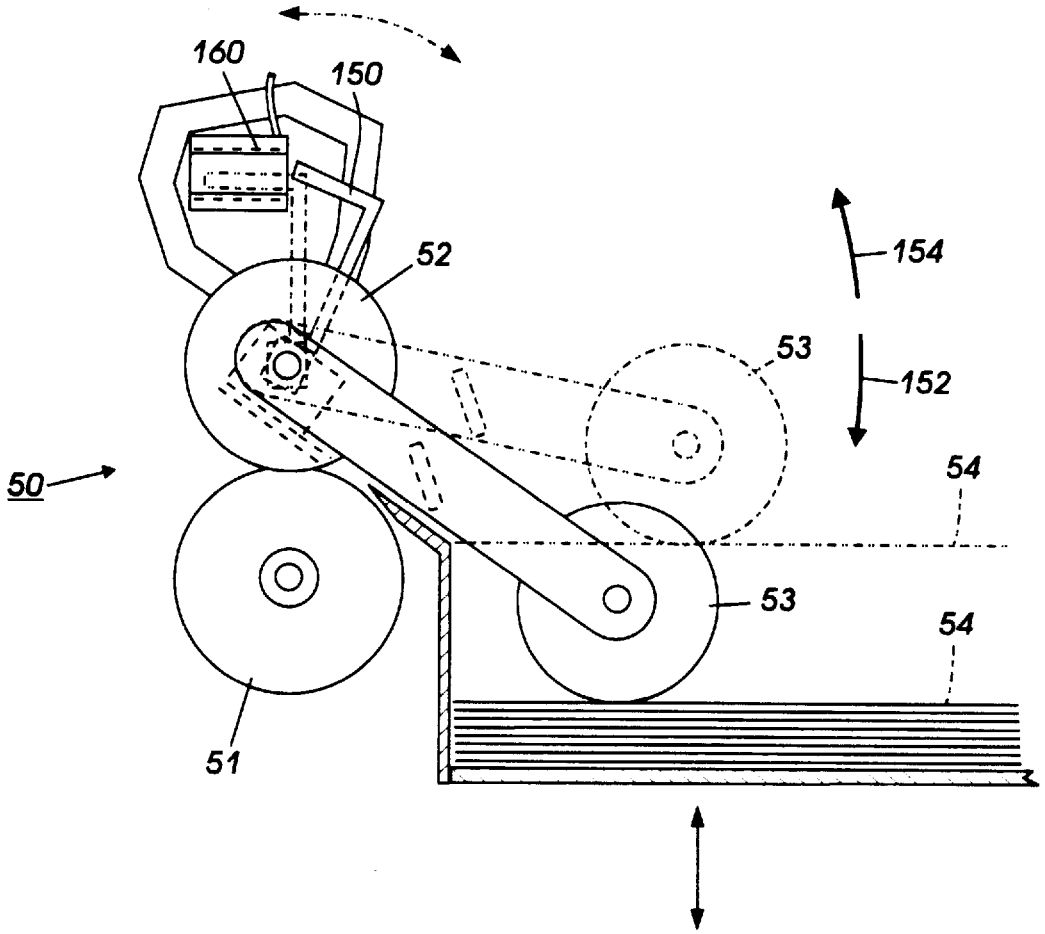
FIG. 2 is a detailed elevational view of the stack height sensing feedhead of the invention herein.

Turning next to FIG. 2, a side elevational view of the feed head 50 is illustrated. The feed head is made up of a nudger roll 53, a feed roll 52, and a retard roll 51. The sheets in the stack 54 are nudged by the nudger roll 53 into the nip formed by the feed roll 52 and the retard roll 51. The nudger roll is mounted on a pivot which is centered more or less on the axis of feed roll 52. As the sheets in the stack 54 are depleted, the nudger roll 53 translates down in the direction of arrow 152 which causes the sensor flag 150, attached/coupled to the support of the nudger roll, to pivot and uncover the sensor 160. The sensor 160 causes the elevator tray drive assembly to actuate, thereby raising the stack and causing the nudger roll 53 to translate upwards in the direction of arrow 154, once again closing sensor 160, which stops the elevator movement. Of course a feed belt acquisiton scheme could also use the same principle to use the feedhead as the sensing member.

As a result of incorporating the stack height sensor into the feedhead, several advantages are realized. There is no additional drag imparted to the sheets as the result of a sensing arm or other sensing member. This also reduces the possibility of skewing the sheets with an additional sensing member. The feedhead, due to the normal force required to acquire the sheets also provides an accurate measurement of stack height. The normal force of the feedhead also eliminates and inaccuracies that could be caused by curled sheets in a feed tray. The stack height is also measured "on the fly" as the sheets are being acquired and fed, thus providing an efficient stack height sensing scheme.

Figure 3:
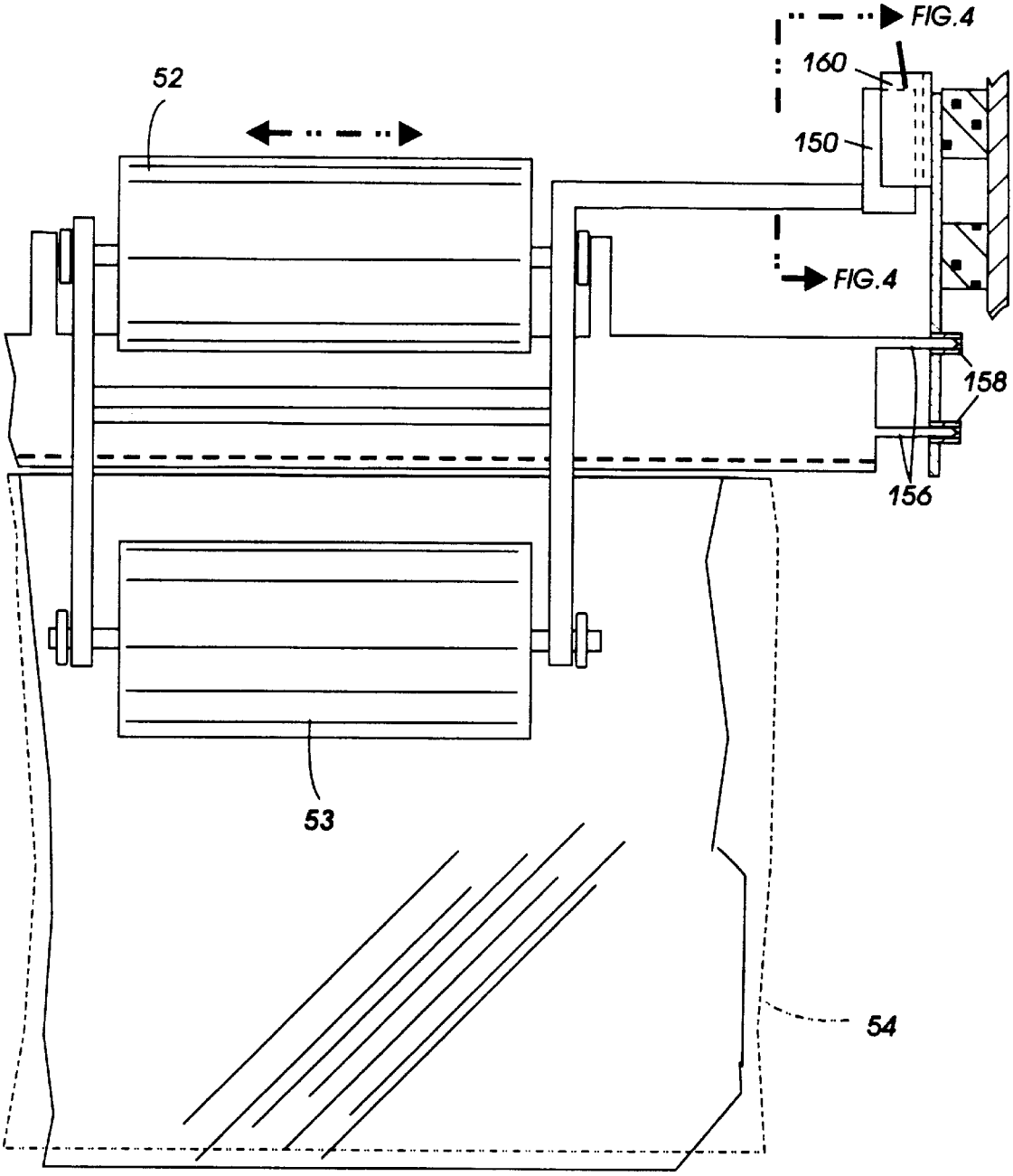
FIG. 3 is a plan view of the stack height sensing feedhead and sensor mechanism of the invention herein.
Figure 4:
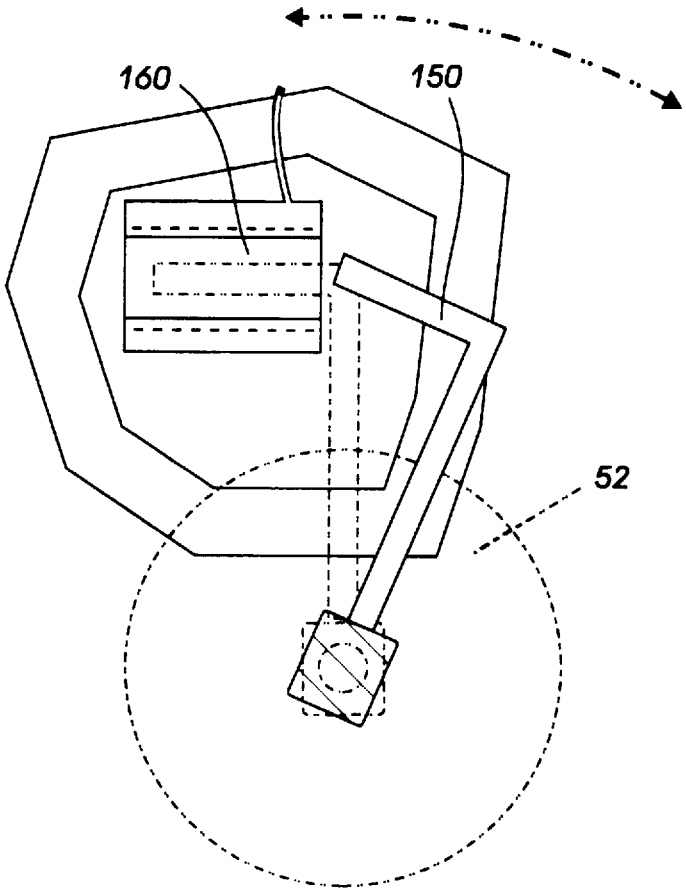
FIG. 4 is a detailed elevational view of the floating sensor mechanism of the invention herein.

The sensor flag 150 is a pivotally mounted flag which is mechanically connected to the pivoting feed head frame. The feed head frame is mounted on the drawer/cassette holding the paper stack. The drawer/cassette or the feed head frame have locating features 156 that will locate sensor unit 160 on an interior member of the printing machine. The sensor flag 150 couples and decouples with the "U" shaped sensor 160 as the drawer/cassette is moved into and out of the printing machine. The flag 150 is connected by an unnumbered extended member to the feedhead frame as seen in FIG. 3. This arrangement is illustrated in FIGS. 3 and 4. The mechanical coupling arrangement eliminates all electrical connections to the feed tray, thereby eliminating one source of breakdown and cost.

Figure 5:
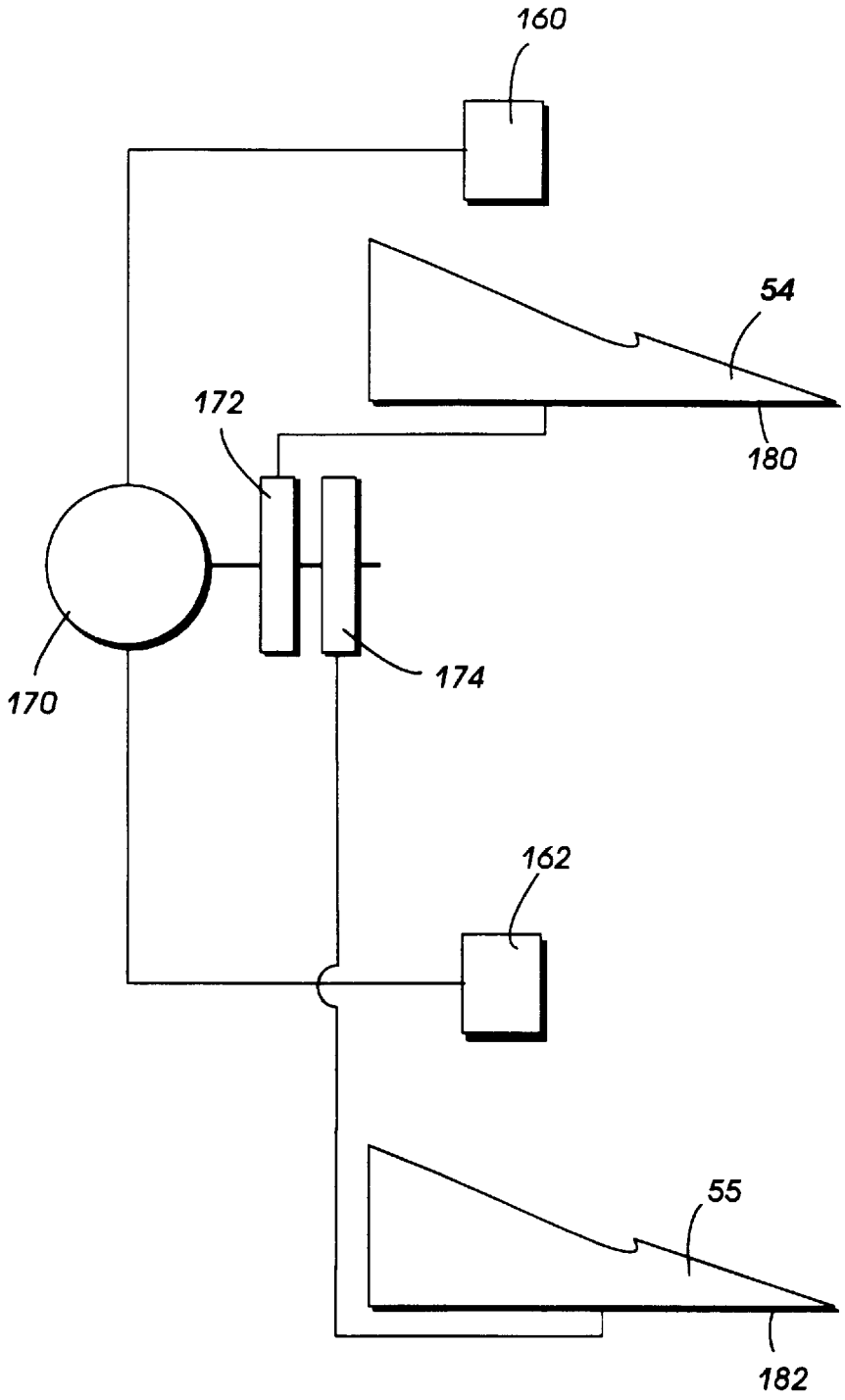
FIG. 5 is a schematic illustration of a elevator drive for a plurality of stack height sensing mechanisms using the invention herein.

FIG. 4 illustrates the mounting of the sensor flag 150 and sensor unit 160 mounted on an interior member of the printing machine. The entire sensor assembly arrangement is modularly mounted and has freedom of movement so that the entire unit will self-align when locating features 156 are inserted into allignment features 158 on the sensor assembly. This movement freedom can be accomplished by several different approaches. One approach illustrated uses a resilient foam type mounting, alternatively, the freedom of movement could be accomplished using spring centered pins in oversized holes to allow for movement of the unit. The mechanical power to elevate the stack is delivered from the interior of the machine to the drawer/cassette via separable couplings FIG. 5 illustrates the entire elevator drive arrangement utilizing two sensors, two trays, and a bi-directional elevator drive motor. The motor 170 drives output shaft 171, which is connected to two single directional clutches, 172 and 174. When the drive motor operates in a first direction (i.e., clockwise) the clutch 172 causes tray 180 to raise. Clutch 174 slips in the clockwise direction and tray 182 remains stationary. When the drive motor 170 receives a signal from sensor 162 it is driven in the opposite direction (counterclockwise) causing clutch 174 to actuate tray 182 and raise the stack within to the feed head of the tray. Clutch 172 slips in the counterclockwise direction, causing tray 180 to remain stationary.

Figure 6:
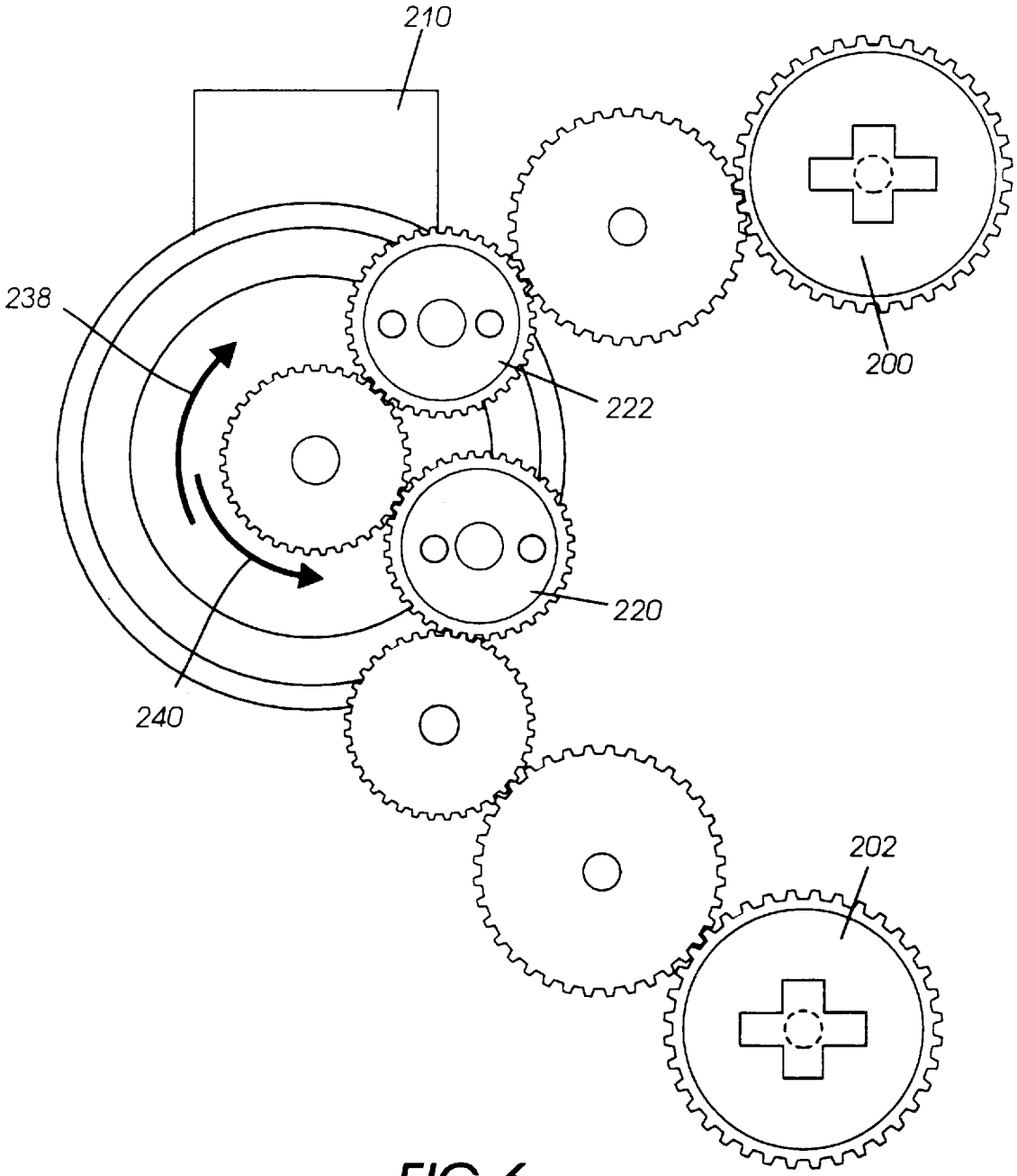
FIG. 6 is a schematic illustration of a feeder drive for a plurality of stacks using the invention herein.

A similar arrangement is illustrated in FIG. 6 for a pair of feedhead drives 200, 202. A bidirectional motor 210 and series of one way clutches 220, 222 connect two feedhead drives 200, 202. When the motor 210 is driven in a first direction 230, the first feedhead 200 is driven to forward sheets to the printing machine. When the motor 210 is reversed 240, the second feedhead 202 is likewise driven. The mechanical power to drive the feedheads is delivered from the interior of the machine to the drawer/cassette via separable couplings As it is not practical to feed from two sources at a time, this arrangement provides an efficient and cost effective feedhead drive scheme.

Thus, it can be seen that there is provided a relatively inexpensive and efficient way to control the operation of two separate sheet feeding trays by the use of a single drive motor and a pair of unidirectional clutches.

In recapitulation, there is provided a stack height control assembly that utilizes the feedhead as the height sensor. A floating flag sensor arrangement can be mounted so that it is engaged with a paper supply drawer/cassette as the drawer/cassette is moved into an operative position. The feedhead by way of the nudger roll acts as the stack height sensor and through a mechanical engagement with the sensor, which is removed and remote from the supply drawer/cassette, signals as the stack is depleted and the elevator mechanism should raise the stack. This control scheme removes complex electrical connectors from the drawer/cassette assembly and allows a wide range of substrates to be fed from the paper supply drawer. By allowing the flag sensor arrangement to float so as to align with the drawer, the need for extremely tight manufacturing and assembly tolerances with respect to the drawer/sensor arrangement is also obviated.

It is, therefore, apparent that there has been provided in accordance with the present invention, a stack height sensing feedhead assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A sheet feeding apparatus for feeding cut sheets from a stack of sheets, comprising:

a sheet support for supporting a stack of sheets, said sheet support moveable from an operative position to a loading position;

a feedhead, attached to said sheet support;

a feedhead sensor, adjacent yet detached from, said sheet support; and a stack height controller, operatively connected to receive a signal from said sensor, to raise the height of the stack in said sheet support as the sheets are fed and the stack height is depleted.

2. An apparatus according to claim 1, wherein said sheet support comprises a slidable drawer for holding a stack of sheets wherein when said drawer is moveable from an active position within a machine to a loading position outside of a machine.

3. An apparatus according to claim 2, wherein said feedhead sensor comprises:

a sensor unit mounted adjacent said drawer;

a member extending from said feedhead which is pivotably mounted on said drawer so that as sheets are fed from the stack the feedhead rotates about an axis.

4. An apparatus according to claim 3, wherein said feedhead member is removably coupled to said sensor unit so that when said drawer is moved from the active position to the loading position, said member decouples from said sensor unit.

5. An apparatus according to claim 4, wherein said feedhead comprises a nudger roll which contacts the top of the stack;

a feed roll to receive sheets forwarded by said nudger roll; and a retard member in contact with said feed roll to form a feed nip therebetween, wherein said feed roll and said nudger roll are pivotally mounted to rotate as a unit about an axis centered on said feed roll.

6. A sheet feeding apparatus for feeding cut sheets from a stack of sheets, comprising:

a sheet support for supporting a stack of sheets, said sheet support moveable from an operative position to a loading position, wherein said sheet support comprises a slidable drawer for holding a stack of sheets;

a feedhead, attached to said sheet support;

a feedhead sensor, adjacent yet detached from, said sheet support wherein said feedhead sensor comprises a sensor unit mounted adjacent said drawer and a member extending from said feedhead which is pivotably mounted on said drawer so that as sheets are fed from the stack the feedhead rotates about an axis, wherein said member extending from said feedhead is removably coupled to said sensor unit so that when said drawer is moved from the operative position to the loading position, said member decouples from said sensor unit; and a stack height controller, operatively connected to receive a signal from said sensor, to raise the height of the stack in said sheet support as the sheets are fed and the stack height is depleted.

7. An apparatus according to claim 6, wherein said feedhead comprises a nudger roll which contacts the top of the stack;

a feed roll to receive sheets forwarded by said nudger roll; and a retard member in contact with said feed roll to form a feed nip therebetween, wherein said feed roll and said nudger roll are pivotally mounted to rotate as a unit about an axis centered on said feed roll.

8. An electrophotographic printing machine wherein sheets are fed from a stack comprising:

a print engine for marking sheets;

a sheet support for supporting a stack of sheets to be fed to said print engine, said sheet support moveable from an operative position to a loading position;

a feedhead, attached to said sheet support;

a feedhead sensor, adjacent yet remote from, said sheet support; and a stack height controller, operatively connected to receive a signal from said sensor, to raise the height of the stack in said sheet support as the sheets are fed and the stack height is depleted.

9. A printing machine according to claim 8, wherein said sheet support comprises a slidable drawer for holding a stack of sheets wherein when said drawer is moveable from an active position within a machine to a loading position outside of a machine.

10. A printing machine according to claim 9, wherein said feedhead sensor comprises:

a sensor unit mounted adjacent said drawer;

a member extending from said feedhead which is pivotably mounted on said drawer so that as sheets are fed from the stack the feedhead rotates about an axis.

11. A printing machine according to claim 10, wherein said feedhead member is removably coupled to said sensor unit so that when said drawer is moved from the active position to the loading position, said member decouples from said sensor unit.

12. A printing machine according to claim 11, wherein said feedhead comprises a nudger roll which contacts the top of the stack;

a feed roll to receive sheets forwarded by said nudger roll; and a retard member in contact with said feed roll to form a feed nip therebetween, wherein said feed roll and said nudger roll are pivotally mounted to rotate as a unit about an axis centered on said feed roll.

13. An electrophotographic printing machine wherein sheets are fed from a stack comprising:

a print engine for marking sheets;

a sheet support for supporting a stack of sheets to be fed to said print engine, said sheet support moveable from an operative position to a loading position, wherein said sheet support comprises a slidable drawer for holding a stack of sheets;

a feedhead, attached to said sheet support;

a feedhead sensor, adjacent yet detached from, said sheet support wherein said feedhead sensor comprises a sensor unit mounted adjacent said drawer and a member extending from said feedhead which is pivotably mounted on said drawer so that as sheets are fed from the stack the feedhead rotates about an axis, wherein said member extending from said feedhead is removably coupled to said sensor unit so that when said drawer is moved from the operative position to the loading position, said member decouples from said sensor unit; and a stack height controller, operatively connected to receive a signal from said sensor, to raise the height of the stack in said sheet support as the sheets are fed and the stack height is depleted.

14. A printing machine according to claim 9, wherein said feedhead comprises a nudger roll which contacts the top of the stack;

a feed roll to receive sheets forwarded by said nudger roll; and a retard member in contact with said feed roll to form a feed nip therebetween, wherein said feed roll and said nudger roll are pivotally mounted to rotate as a unit about an axis centered on said feed roll.

* * * * *